United States Patent [19]

Hilmer

[11] Patent Number: 4,689,573

[45] Date of Patent: Aug. 25, 1987

[54] ON-VEHICLE DIAGNOSTIC UNIT FOR ELECTRONIC IGNITION SYSTEMS

[75] Inventor: Frederick W. Hilmer, Cincinnati, Ohio

[73] Assignee: Switches, Inc., Logansport, Ind.

[21] Appl. No.: 767,638

[22] Filed: Aug. 20, 1985

[51] Int. Cl.[4] ..... F02P 17/00

[52] U.S. Cl. ..... 324/380; 324/500

[58] Field of Search ..... 324/380, 381, 382, 51

[56] References Cited

U.S. PATENT DOCUMENTS 4,331,921 5/1982 Walker ..... 324/380
4,331,922 5/1982 Walker ..... 324/380
4,333,054 6/1982 Walker ..... 324/380
4,449,100 5/1984 Johnson et al. ..... 324/380 X

*Primary Examiner*—Reinhard J. Eisenzopf
*Assistant Examiner*—Robert W. Mueller
*Attorney, Agent, or Firm*—Hill, Van Santen, Steadman & Simpson

[57] ABSTRACT

An on-vehicle diagnostic unit for an electronic ignition system monitors input signal received and output signals produced by the electronic ignition control unit on a continuous basis and displays an indiction of proper operation or failure. The failure indication is produced in response to a permanent or intermittent failure, irrespective of the failure mode of the electronic ignition control unit.

11 Claims, 4 Drawing Figures

ON-VEHICLE DIAGNOSTIC UNIT FOR ELECTRONIC IGNITION SYSTEMS

BACKGROUND

1. Field of Invention

The present invention relates to a diagnostic unit and more particularly to a diagnostic unit for diagnosing operation of an electronic ignition system.

2. The Prior Art

Electronic ignition control systems utilize transducers which develop signals which are furnished to the electronic ignition control unit. Based on such signals, the control unit switches on and off the primary side of the ignition coil. In current systems there is no indication furnished to the operator in response to failure of the transducer, or of the control unit.

Because the control unit is of the solid state electronic type, there is no visible means of determining if the unit is functional. In order to test it satisfactorily, it must be removed from the vehicle.

It is therefore desirable to provide an apparatus and method for overcoming the limitations of existing systems.

BRIEF SUMMARY OF THE INVENTION

It is the principal object of the present invention to provide a visual means for indicating operation of the electronic ignition control unit. In the event of failure of the electronic ignition control module, the vehicle is inoperative until the failure can be traced and the faulty unit replaced. Since a relatively complex procedure is involved in removing and testing the unit, it is desirable to avoid such removal and testing if not required. Also, in the case of a discontinuous or intermittent failure, it is difficult to simulate the environmental conditions at the time of failure during off-vehicle testing. By means of the present invention, a visual indication is stored and displayed indicating failure of the electronic ignition control system even though the failure may have been momentary.

In one embodiment, the invention incorporates an electrical connection to an existing electronic ignition control unit, whereby signals arriving over said connection may be inspected to monitor the function of the electronic control unit. The signals received over the connection include the input signals received by the electronic control unit, and the corresponding ignition coil pulses which are produced as outputs therefrom, and which are generated by a predetermined time after the arrival of the input signals. If the system fails to detect coil pulses at the prescribed times, failure signals pass through the comparison section to a non-erasable memory. A display unit then displays the condition of the non-erasable memory, indicating proper operation (or failure), by means of a green (or red) indicator.

BRIEF DESCRIPTION OF THE DRAWINGS

Reference will now be made to the accompanying drawings in which.

DESCRIPTION OF THE PREFERRED EMBODIMENT

Figure 1:
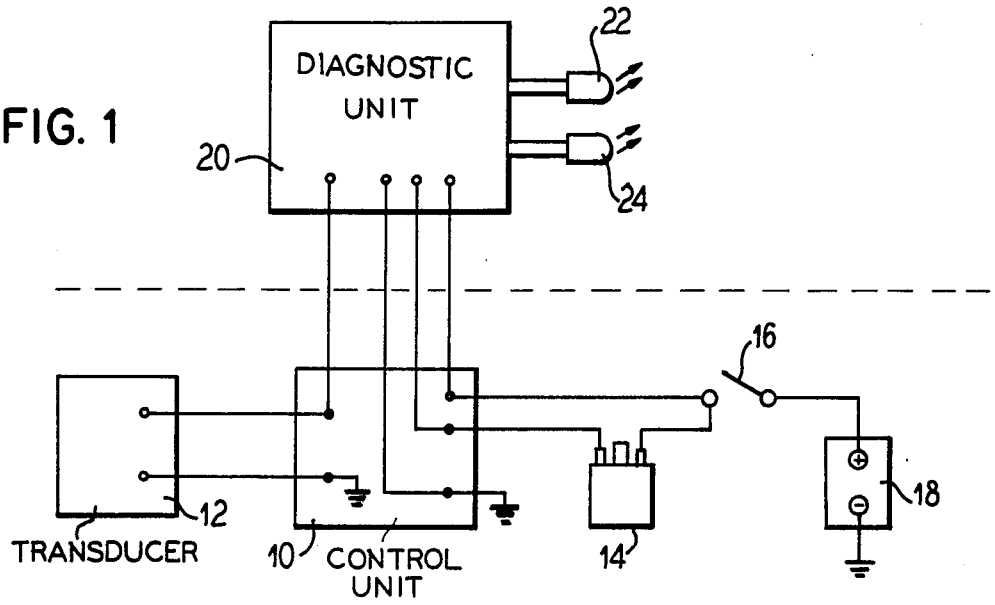
FIG. 1 is a functional block diagram of a diagnostic system incorporating an illustrative embodiment of the present invention.

Referring now to the drawings, FIG. 1 illustrates a conventional electronic ignition control unit 10, connected with a transducer 12, a key operated switch 16, a coil 14, and a battery 18. This comprises a conventional system, commonly employed in modern motor vehicles. In the present invention, a diagnostic unit 20 is connected with the control unit 10 (via terminals A–D) to receive signals produced by the transducer 12 as input signals to the control unit 10, and signals produced by the control unit which are furnished to the coil unit 14. Two indicator lights 22 and 24 are selectively illuminated to indicate failure, or proper operation, of the control unit 10.

The transducer 12 generates voltage signals in time spaced succession, to trigger operation of the control unit 10. The control unit, the diagnostic unit and the ignition coil draw power from the battery 18, when the key switch 16 is closed. Otherwise the energy of the battery is conserved, as in conventional systems.

Figure 2:
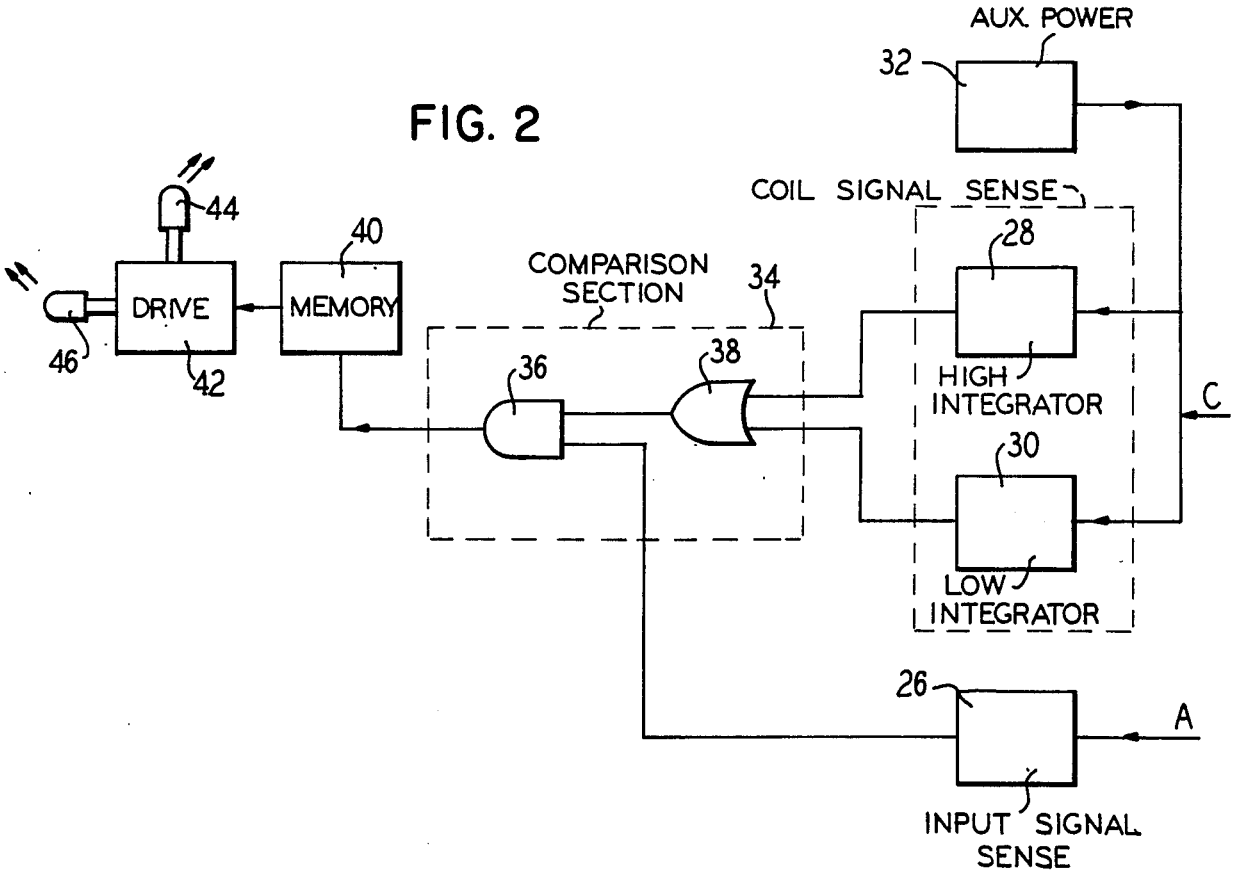
FIG. 2 is a functional block diagram of the diagnostic unit illustrated in FIG. 1.

FIG. 2 illustrates a functional block diagram of the diagnostic unit 20. Input signals from the transducer 12 are connected from terminal A to an input signal sense unit 26, while the signal received from the coil 14 at terminal C is connected to a coil signal sense unit incorporating a high integrator 28 and a low integrator 30. The high integrator 28 is functional for integrating high level signals, while the low integrator 30 is operative to integrate low level signals.

The integrating units 28 and 30 each produce a signal which is connected as an input to a comparison section 34, which comprises an AND gate 36 and an OR gate 38. The two inputs are connected to the two inputs of the OR gate, and the output of the OR gate is connected as one input of the AND gate 36. The other input of the AND gate 36 is derived from the output of the input signal sense unit 26. The comparison section 34 produces an output signal in response to the detection of a logical fault condition, and this is supplied to a memory unit 40 for storage. Memory unit 40 is a non-volatile type of memory, so that it permanently maintains its state stored in response to a signal received from the comparison section 34. A drive unit 42 is connected to the memory unit 40 and furnishes a drive signal to a lamp 46 for an indication that a fault signal has not been received and stored by the memory 40, or alternatively to a lamp 44 to indicate that a fault condition has occurred.

Figure 3:
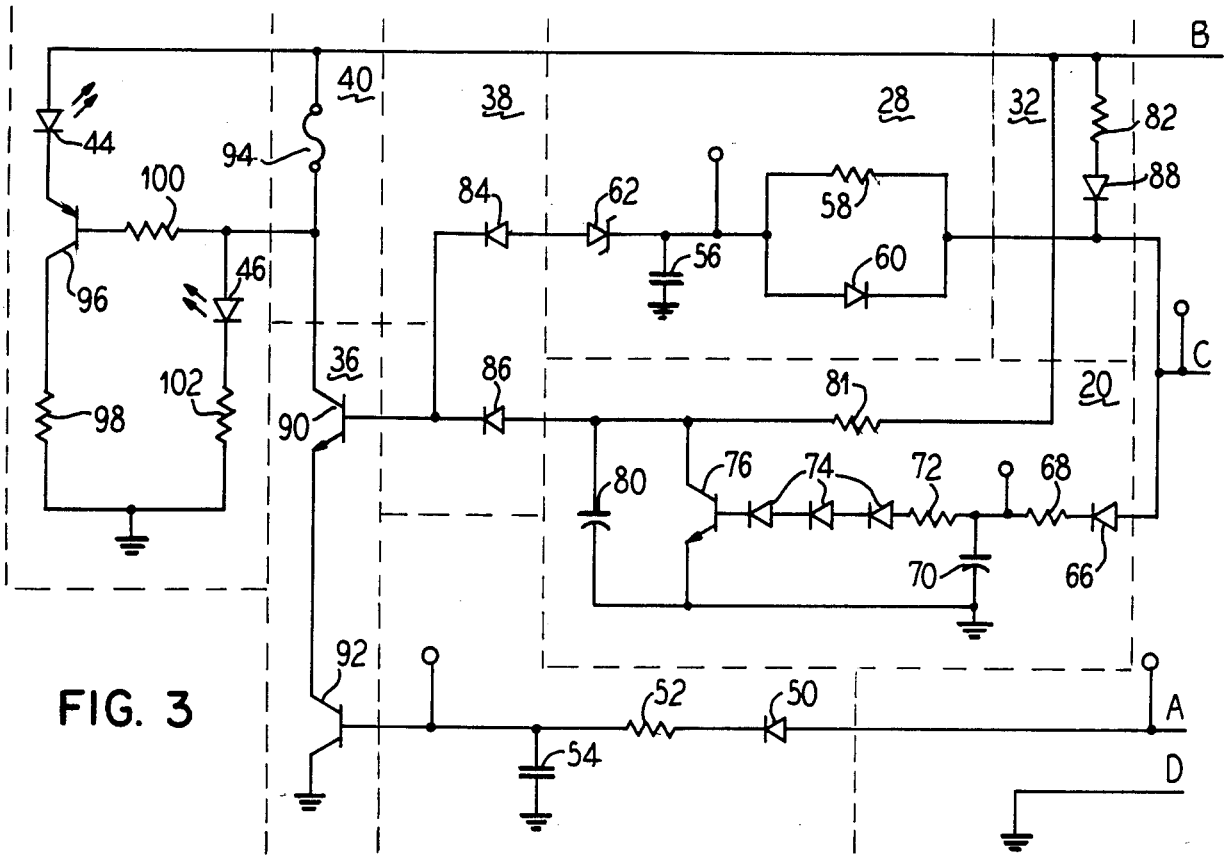
FIG. 3 is a schematic diagram of circuitry corresponding to the apparatus of FIG. 2.
Figure 4:
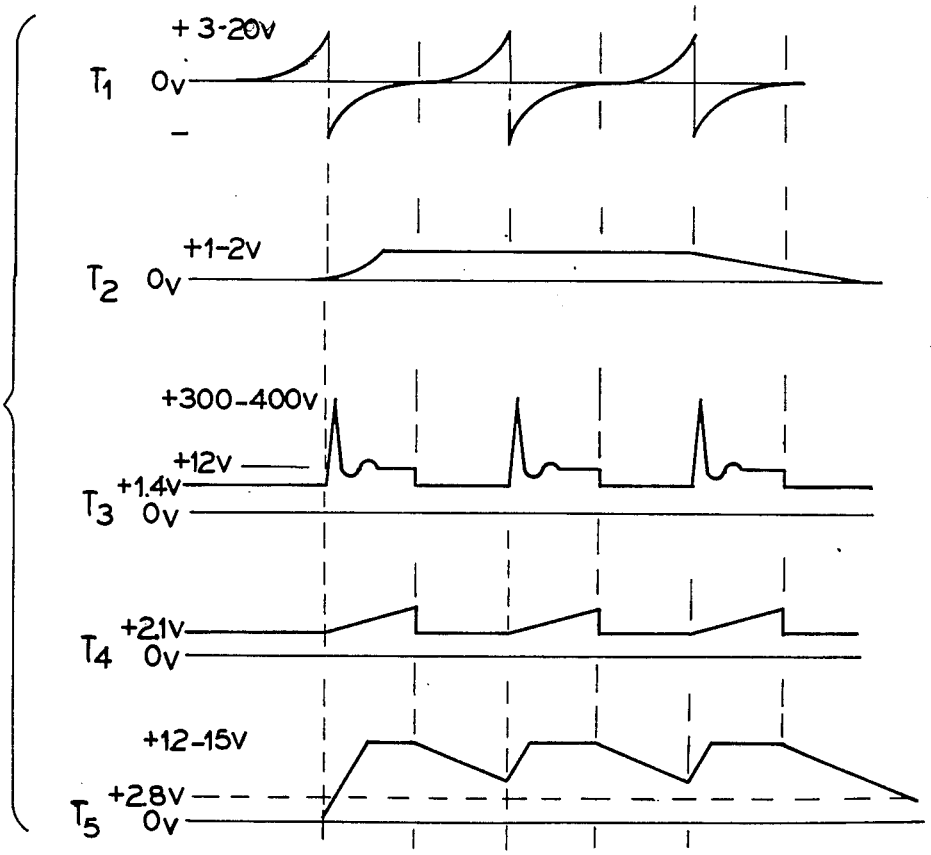
FIG. 4 is a series of operating wave forms illustrating operation of the circuit of FIG. 3.

Referring to FIG. 3 the signal (FIG. 4-1) arriving over terminal A is applied to a diode 50 which is connected through a resistor 52 to a capacitor 54. The capacitor 54 is charged by the signal through the resistor 52 and the diode 50. The resistor 52 provides input isolation so that the circuit will not load down the transducer (connected to terminal A) during conduction of the diode 50. The voltage level on the capacitor 54 is shown in FIG. 4-2.

The signal (FIG. 4-3) from the coil, arriving at terminal C, is connected to the high integrator 28 and the low integrator 30. The high integrator 28 incorporates a capacitor 56, which is charged and discharged by a circuit including resistor 58 and diode 60, so that a ramp voltage appears across the capacitor 56 (shown in FIG. 4-4). The resistor 58 charges the capacitor with a rising slope, corresponding to the R-C time constant of the resistor 58 and the capacitor 56. The diode 60 rapidly discharges the capacitor, when the voltage level at terminal C falls, producing a substantially vertical slope.

During normal operation of the electronic ignition control unit, the peak of the voltage on the capacitor 56 never rises to the breakdown of zener diode 62 which is connected to the capacitor 56. However, if the electronic ignition control unit fails in an open (or non-conducting) mode, so that terminal C remains high, the diode 60 does not conduct to discharge the capacitor 56, so that the voltage level on the capacitor 56 rises to battery voltage, greater than the breakdown of the zener diode 62. This causes the zener diode 62 to conduct, and current flows through a diode 84, causing a failure signal to be generated.

In the low integrator 30, the signal is passed through a diode 66, and a resistor 68, to a capacitor 70. The capacitor 70 is thus charged up with an R-C time constant corresponding to the values of the resistor 68 and the capacitor 70, as shown in FIG. 4-5. The capacitor 70 is discharged through a resistor 72 and three series-connected diodes 74, which connect the capacitor 70 to the base of a transistor 76. The discharge of the capacitor 70 is with an R-C time constant corresponding to the values of the capacitor 70 and the resistor 72, as well as the effective resistance of the diodes 74, and of the base emitter junction of the transistor 76. The result is a sloping trailing edge to the wave form illustrated in FIG. 4-5.

During normal operation of the electronic control unit, the capacitor 70 remains sufficiently charged to cause the diodes 74 to remain in continuous conduction, providing drive to the base of the transistor 76. A capacitor 80 is connected across the emitter and collector terminals of the transistor 76, so that the capacitor 80 is normally not permitted to accept a charge. When the electronic ignition control unit fails in a shorted or zero signal mode (with the voltage level at C low), the diode 66 does not conduct, and the voltage across the capacitor 70 decreases, as it is discharged through the resistor 72. When the voltage on this capacitor falls sufficiently, the diodes 74 can no longer conduct current, so that the transistor 76 is cut off, no longer maintaining the capacitor 80 in discharged condition. Then the capacitor 80 is permitted to charge through resistor 81, which connects the capacitor to the power source at terminal B. The rate of which the capacitor 80 is charged, which is controlled by the resistor 81, is selected to be sufficiently slow so that the capacitor 80 does not become appreciable charged during initial start up of the motor vehicle, before the capacitor 70 is fully charged through the resistor 68. In this way a false failure indication is avoided.

The C terminal normally receives power from the ignition coil 14. Should the ignition coil become disconnected from the control unit 10, the auxiliary power source 32 will provide enough power into the C terminal for the diagnostic unit 20 to function properly.

The diode 88 conducts only when the voltage level at terminal C becomes less than battery voltage. The high voltage spike produced by the coil, being greater than the battery voltage, will cause diode 88 not to conduct, thus preventing resistor 82 from drawing current from the high voltage spike. Should the battery voltage from the coil not appear at terminal C, diode 88 conducts providing current limited by resistor 82 enabling capacitor 70 to remain sufficiently charged as not to give a false signal from low integrator 30.

A diode 86 is connected to the capacitor 80, and forms, in combination of the diode 84, the OR gate 38. The higher of the two signals applied to the anodes of the diode 84 and 86 is passed to the base of a transistor 90. The AND gate 36 comprises the transistor 90 and another transistor 92 connected in series therewith. The base of the transistor 92 is connected to the capacitor 54, so that it becomes conductive during the period when the capacitor 54 is charged to a level above the threshold level of the transistor 92.

During normal operation, the transistor 92 is conductive, but the OR gate 38 does not provide a drive signal to the transistor 90 so that the AND gate 36 is not conductive. When the OR gate 38 passes a signal from either of the failure detection circuits 28 or 30, the transistor 90 receives drive, causing it to conduct and producing a failure signal. The memory unit 40 is comprised of a fuse 94 interconnected between the series connected transistors 90 and 92 and the power source connected to terminal B. When both transistors are conductive, sufficient current is drawn through the fuse 94 so that it burns out, which represents an irreversible change in its condition.

The visual indicator circuit incorporates light emitting diodes 44 and 46. The diode 44 is connected from the power source at terminal B through a transistor 96 and a resistor 98. The base of the transistor 96 is connected through a resistor 100 and the fuse 94 to the power source. As long as the fuse 94 is intact, the transistor 96 cannot conduct, and the diode 44 remains dark. The diode 46 is connected from the power source through the fuse 94 and through resistor 102 to ground. Thus as long as the fuse is intact, the diode 46 conducts current and is illuminated, indicating proper operation. When the fuse is blown however, in response to a failure detection, the diode 46 receives only the base current flowing through the emitter-base junction of the transistor 96, which is not enough to illuminate the diode 46. The base emitter current of the transistor 96 flows through the LED, 44, however illuminating it and indicating visually a failure condition of the electronic ignition control unit.

From the foregoing, it is seen that the present invention provides a simple and effective mechanism for positively indicating the failure condition of the electronic ignition control unit. This indication is a signal for the electronic ignition control unit to be replaced, eliminating guess work as to the possible cause of an intermittent failure condition. At the same time, when the original LED remains illuminated, the electronic ignition control unit can be ruled out as a source of a problem, simplifying diagnosis, in eliminating unnecessary and expensive testing or replacement of the electronic ignition control unit.

It is apparent that various additions and modifications in the apparatus described above may be made by those skilled in the art, without departing from the essential features of novelty thereof, which are intended to be defined and secured by the appended claims.

What is claimed is:

1. An electronic ignition monitoring circuit incorporating means for sensing an input signal supplied to an electronic ignition control unit, means for generating a control signal in response to non-operation of said electronic ignition control unit, first display means for displaying a visual indication of non-failure of the electronic ignition control unit, second display means for displaying a visual indication of failure of the electronic ignition control unit when said control signal is produced in coincidence with said input signal, and means for operating said first and second display means mutually exclusively, whereby either said first display means or said second display means is continuously active.

2. Apparatus according to claim 1 wherein said means for generating said control signal incorporates means operative in response to a failure mode of said electronic ignition control unit in which the output signal therefrom remains at a high level.

3. Apparatus according to claim 1 wherein said means for generating said control signal incorporates means operative in response to a failure mode of said electronic ignition control unit in which the output signal therefrom remains at a low level.

4. An electronic ignition monitoring circuit incorporating means for sensing an input signal supplied to an electronic ignition control unit, means for generating a control signal in response to non-operation of said electronic ignition control unit, means for displaying a visual indication of failure of the electronic ignition control unit when said control signal is produced in coincidence with input signal, and a non-volatile memory unit connected to store a failure indication when said control signal is produced coincident with said input signal, whereby the state of said memory unit indicates a previous failure of said electronic ignition control unit irrespective of whether said failure is permanent or intermittent.

5. Apparatus according to claim 4 including a pair of indicator lights, and means connected to said memory for illuminating one or the other of said lamps in accordance with the state of said memory unit.

6. An electronic ignition monitoring circuit incorporating means for sensing an input signal supplied to an electronic ignition control unit, means for generating a control signal in response to non-operation of said electronic ignition control unit, means for displaying a visual indication of failure of the electronic ignition control unit when said control signal is produced in coincidence with said input signal, and an auxiliary power source, said means for generating said control signal being operative in response to said auxiliary power source in the event of disconnection of the ignition coil of said electronic ignition from said control unit.

7. An electronic ignition monitoring circuit incorporating means for sensing an input signal supplied to an electronic ignition control unit, means for generating a control signal in response to non-operation of said electronic ignition control unit, and means for displaying a visual indication of failure of the electronic ignition control unit when said control signal is produced in coincidence with said input signal, said control signal generator incorporating an R-C integrator circuit, connected to receive the output of said electronic ignition, and a zener diode connected to the capacitor of said R-C circuit, said capacitor normally not being charged to the zener voltage of said zener diode proper operation of said electronic ignition control unit, and means for charging said capacitor above said zener potential during failure of said electronic ignition control unit in a failure mode which produces a high output signal, said control signal being produced via said zener diode.

8. An electronic ignition monitoring circuit incorporating means for sensing an input signal supplied to an electronic ignition control unit, means for generating a control signal in response to non-operation of said electronic ignition control unit, and means for displaying a visual indication of failure of the electronic ignition control unit when said control signal is produced in coincidence with said input signal, said means for generating a control signal incorporating a R-C integrator connected to the output of said electronic ignition control unit, discharge means connected across said capacitor for continuously discharging said capacitor at a rate which allows the capacitor normally to exhibit a voltage level in excess of a given threshold voltage, and means for developing said control signal when the voltage across the capacitor falls below said threshold level.

9. Apparatus according to claim 8 including a transistor connected to the capacitor of said R-C circuit, said transistor being normally conductive for inhibiting production of said control signal, and means for cutting off said transistor in response to the voltage across said capacitor falling below said threshold level.

10. Apparatus according to claim 15 including a further R-C circuit, means connecting the capacitor of said further R-C circuit to a source of potential for charging it at a predetermined rate, said transistor being connected across said capacitor of said further R-C circuit for maintaining the said capacitor in a discharged condition as long as said electronic ignition control unit is functioning normally, and allowing the voltage level on said further capacitor to increase to produce said control signal in response to failure of said electronic ignition control unit in a mode which leaves the output signal low.

11. Apparatus according to claim 10 wherein the time constant of said further R-C circuit is sufficiently long to prevent said further capacitor from producing said control signal during initial operation of the motor vehicle.

* * * * *

UNITED STATES PATENT AND TRADEMARK OFFICE

CERTIFICATE OF CORRECTION

PATENT NO. : 4,689,573

DATED : August 25, 1987

INVENTOR(S) : Frederick W. Hilmer

It is certified that error appears in the above-identified patent and that said Letters Patent is hereby corrected as shown below:

Column 6, line 36, "15" should read "8".

Signed and Sealed this

First Day of August, 1989

*Attest:*

*Attesting Officer*

DONALD J. QUIGG

*Commissioner of Patents and Trademarks*